US006637496B1

(12) United States Patent
Macheske et al.

(10) Patent No.: US 6,637,496 B1
(45) Date of Patent: Oct. 28, 2003

(54) ROTARY CASTING SYSTEM FOR PRESSURIZED CASTING MACHINES

(75) Inventors: Robert L. Macheske, Tawas City, MI (US); Thomas J. H. Rozich, Au Gres, MI (US); Alan P. Gould, Tawas City, MI (US); Daniel D. Minor, Cadillac, MI (US); Kenneth D. McKibben, Defiance, OH (US)

(73) Assignee: Hayes Lemmerz International, Inc., Northville, MI (US)

( * ) Notice: Subject to any disclaimer, the term of this patent is extended or adjusted under 35 U.S.C. 154(b) by 0 days.

(21) Appl. No.: 09/997,076

(22) Filed: Nov. 30, 2001

(51) Int. Cl.[7] ..... B22D 18/04; B22D 5/02; B22D 39/00

(52) U.S. Cl. ..... 164/119; 164/133; 164/306; 164/326; 164/337

(58) Field of Search ..... 164/133, 134, 164/135, 136, 335, 336, 337, 129, 130, 322, 323, 324, 325, 326, 329, 119, 306

(56) References Cited

U.S. PATENT DOCUMENTS 5,215,141 A * 6/1993 Kuhn et al. ..... 164/457
5,230,379 A 7/1993 Voss ..... 164/63
5,601,135 A 2/1997 Merrill ..... 164/306
5,701,945 A * 12/1997 McKibben et al. ..... 164/130

FOREIGN PATENT DOCUMENTS

DE 34 22 121 A1 * 12/1985 ..... B22D/17/00
JP 57-64466 * 4/1982 ..... B22D/18/04

* cited by examiner

*Primary Examiner*—M. Alexandra Elve
*Assistant Examiner*—Kevin P. Kerns
(74) *Attorney, Agent, or Firm*—MacMillan, Sobanski & Todd, LLC

(57) ABSTRACT

Apparatus for making a cast article includes a rotary table with a drive for indexing the rotary table to a plurality of rotational positions. A molten metal supply apparatus is placed at a first fixed location adjacent to said rotary table. A plurality of casting machines are supported at predetermined spacings on the rotary table, each respective casting machine having a respective holding furnace feeding a respective stalk tube and having a molten metal inlet port for receiving molten metal from the molten metal supply apparatus when the respective casting machine is indexed to a fill position adjacent the first fixed location. Each respective casting machine is adapted to receive one or more molds and has an open mold configuration and a closed mold configuration. A cast article removal apparatus is placed at a second fixed location adjacent the rotary table for removing the cast article from a respective casting machine when the respective casting machine is at an unload position adjacent the second fixed location and is in the open mold configuration.

9 Claims, 5 Drawing Sheets

ROTARY CASTING SYSTEM FOR PRESSURIZED CASTING MACHINES

BACKGROUND OF THE INVENTION

The present invention relates, in general, to the layout and use of a plurality of low-pressure permanent mold (LPPM) casting machines, and more specifically to deployment of modified LPPM casting machines on a rotary table.

It is known to use a low pressure countergravity casting apparatus to cast molten metal into a mold. One example of such an apparatus is described in U.S. Pat. No. 5,215,141, which is incorporated herein by reference. Basically, in a low pressure countergravity casting apparatus, metal (e.g., aluminum) is melted in a melt furnace and then supplied to a holding furnace. The holding furnace includes a supply conduit for introducing a gas under pressure into the holding furnace. As the gas is introduced, the molten metal is forced through a submerged feed tube into the mold. The feed tube is commonly referred to as a stalk tube. The mold receives the molten metal through holes in the bottom of the mold.

The holding furnace located beneath the mold in a prior art LPPM casting machine has been constructed to operate in a fixed location near a supply of molten metal. A human operator monitors machine operation, such as removing cast parts and operating molten metal refill equipment. Due to the structure and operation of prior art LPPM machines, one human operator could tend at most two or perhaps three machines simultaneously. It would be desirable to reduce the manufacturing floor space required for LPPM machines and to reduce the need for human operators.

SUMMARY OF THE INVENTION

The present invention has the advantage of successfully molding articles in low pressure permanent mold casting machines while reducing floor space, capital expense, and labor costs.

In one preferred aspect of the invention, apparatus for making a cast article comprises a rotary table with a drive for indexing the rotary table to a plurality of rotational positions. Molten metal supply apparatus is placed at a first fixed location adjacent to said rotary table. A plurality of casting machines are supported at predetermined spacings on the rotary table, each respective casting machine having a respective holding furnace feeding a respective stalk tube and having a molten metal inlet port for receiving molten metal from the molten metal supply apparatus when the respective casting machine is indexed to a fill position adjacent the first fixed location. Each respective casting machine is adapted to receive a mold and having an open mold configuration and a closed mold configuration. A cast article removal apparatus is placed at a second fixed location adjacent the rotary table for removing the cast article from a respective casting machine when the respective casting machine is at an unload position adjacent the second fixed location and is in the open mold configuration.

Further advantages of this invention will become apparent to those skilled in the art from the following detailed description of the preferred embodiment, when read in light of the accompanying drawings.

DETAILED DESCRIPTION OF PREFERRED EMBODIMENTS

Figure 1:
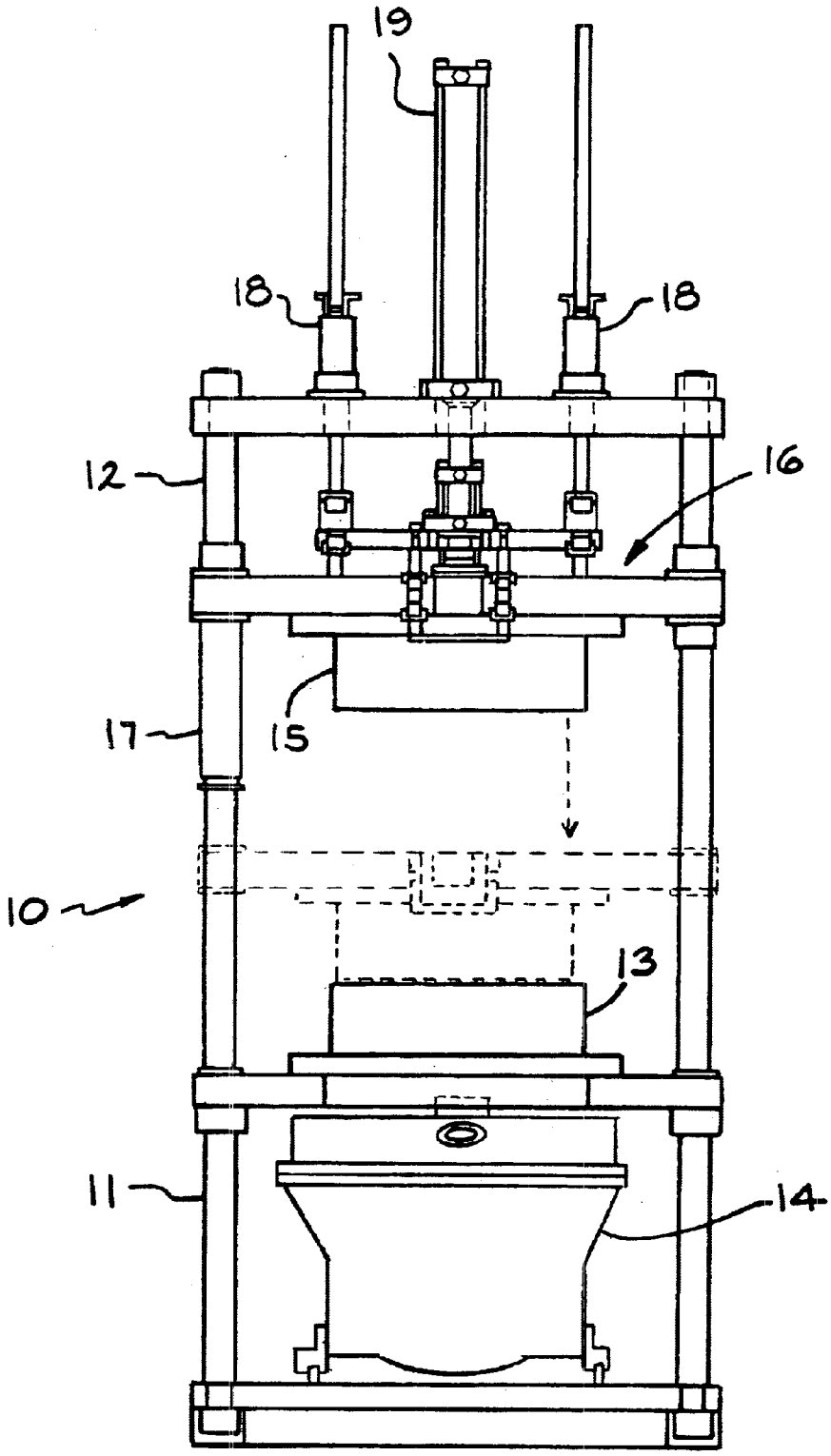
FIG. 1 is a front elevational view of a low pressure permanent mold casting machine used in the present invention.
Figure 2:
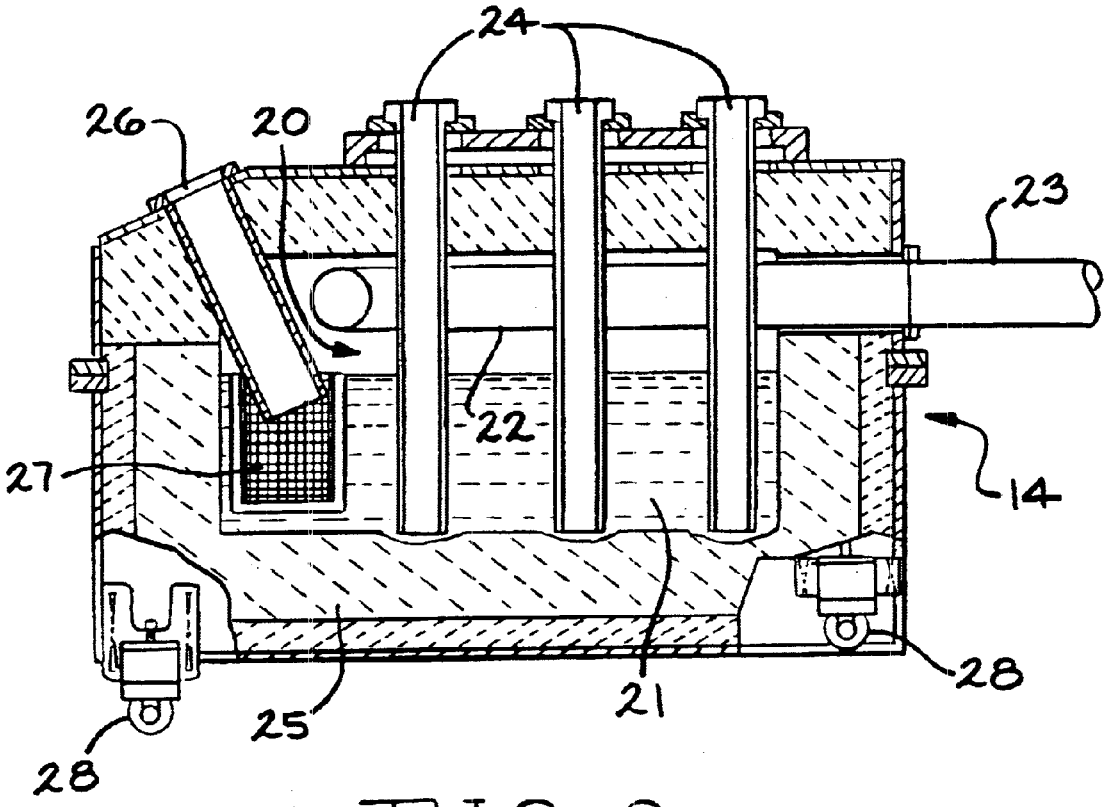
FIG. 2 is a partially cross-sectioned side view of a holding furnace of the casting machine of FIG. 1.
Figure 3:
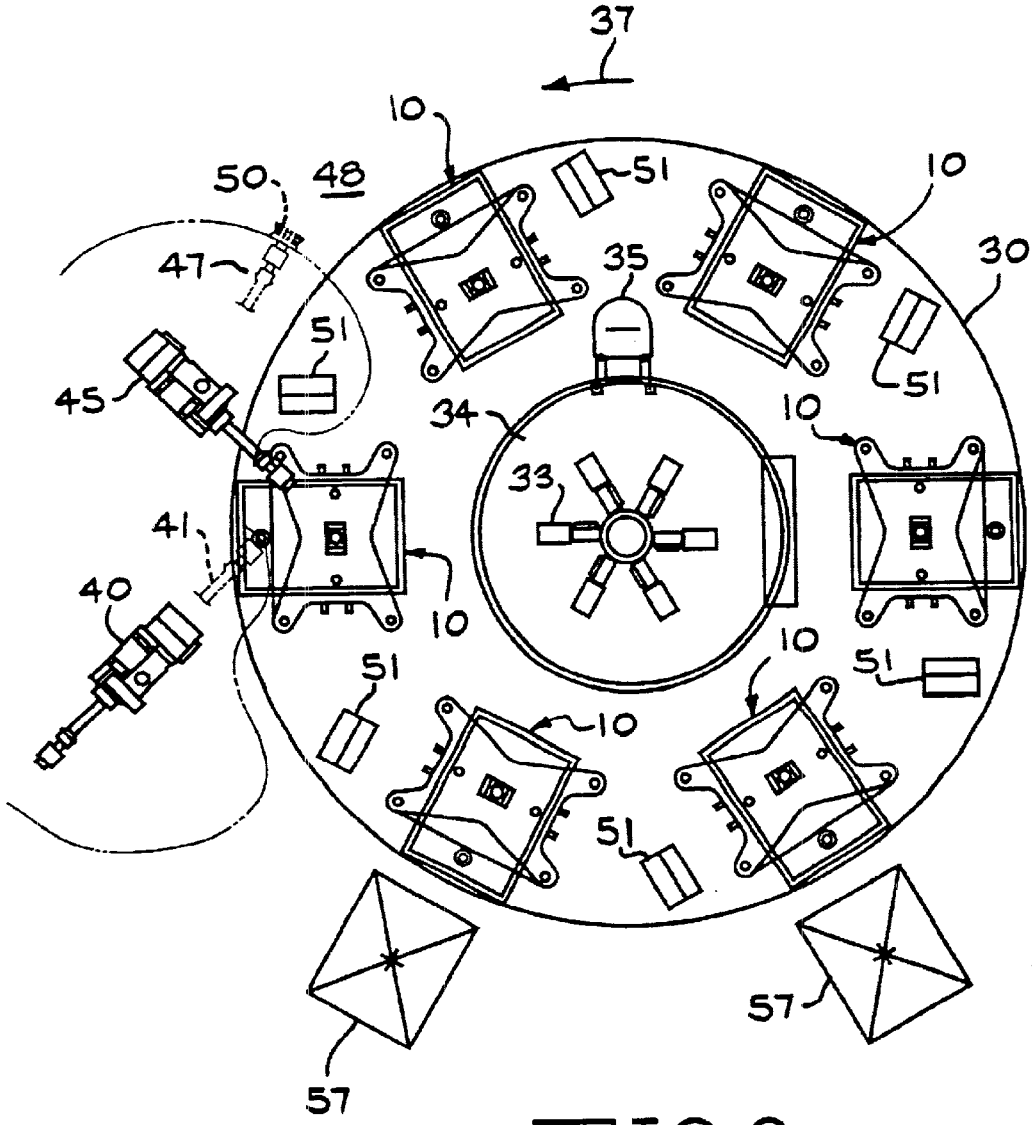
FIG. 3 is a plan view of a rotary casting system according to the invention.
Figure 4:
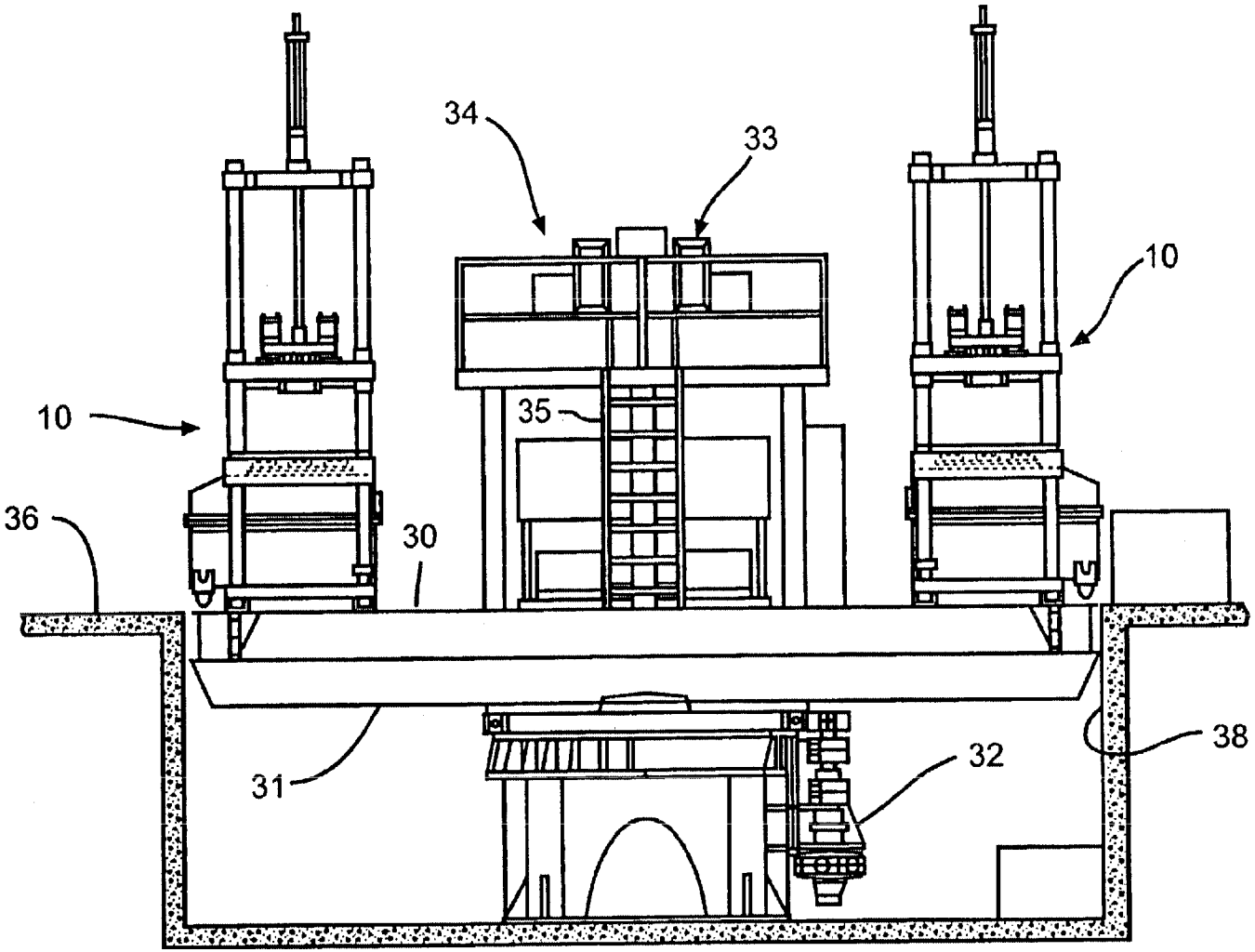
FIG. 4 is an elevational view of the rotary casting system of FIG. 3.
Figure 6:
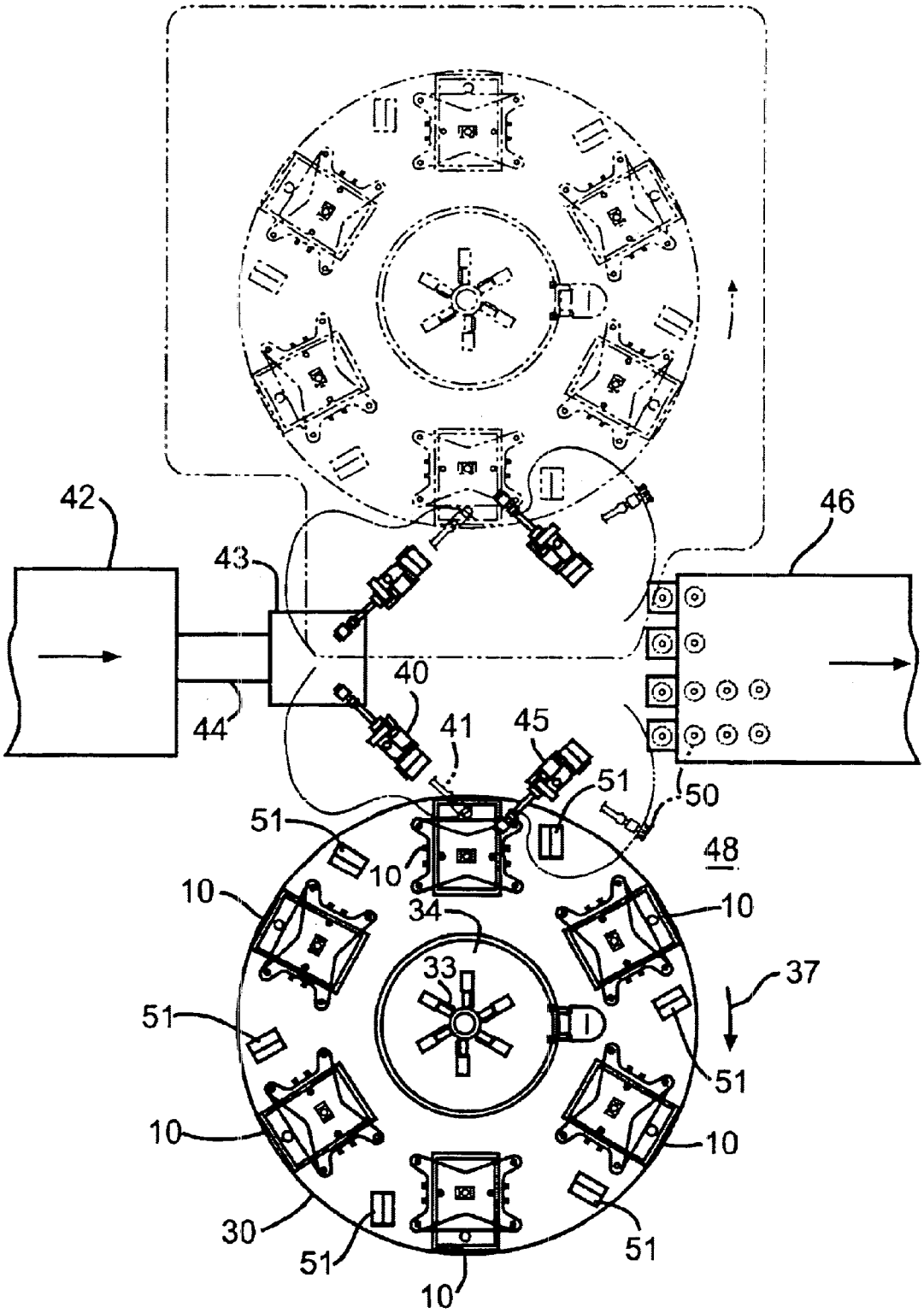
FIG. 6 is a plan view of two rotary casting systems integrated side by side for additional efficiency.

FIGS. 1 and 2 illustrate a low pressure permanent mold casting machine 10. The general structure and operation of such casting machines are conventional in the art. Thus, only those portions of the casting machine 10 which are necessary for a full understanding of this invention will be explained and illustrated in detail. The preferred embodiment of deploying casting machine 10 in the rotary casting system is illustrated in FIGS. 3, 4 and 6.

Referring now to FIG. 1, casting machine 10 includes a frame with lower portion 11 and an upper portion 12. Lower portion 11 is operative to support a machine holding furnace 14 and a mold bottom section 13. Upper portion 12 is operative to support a mold top section 15. One or more molds can be fitted into the machine at any one time. The casting machine frame registers a fixed location of casting machine 10 on the rotary table, as will be described below. Casting machine 10 is shown in FIG. 1 is in an open mold configuration which allows for removal of a finished cast article and for inspection of the mold or molds prior to the next casting cycle. Casting machine 10 also has a closed mold configuration as shown in dashed lines.

A sliding frame portion 16 includes a cylindrical sleeve 17 for guiding frame portion 16 between raised and lowered positions and clamps 18 that can be engaged to hold frame portion 16 in one position. Linear drive means 19 can be controlled automatically or manually to obtain the open and closed mold configurations.

Holding furnace 14 is shown in greater detail in FIG. 2. A chamber or crucible 20 retains a supply of molten metal 21. Heat to maintain the liquid state of molten metal 21 can be provided, for example by a gas-fired radiant heat tube 22 supplied with natural gas via an inlet 23. An outlet for exhaust is not shown. Other means of heating such as electric radiant heaters or electric immersion heaters can also be employed. Crucible 20 is insulated by a refractory liner 25.

Stalk tubes 24 penetrate near the bottom of crucible 20 and extend upwards to feed molten metal to the mold or molds. Pressurized gas is introduced into crucible 20 above molten metal 21 to force molten metal into stalk tubes 24 by a pump and gas injection valve (not shown).

Refills of molten metal are provided to holding furnace 14 through a metal fill port 26. Optionally, the molten metal newly transferred into holding furnace 14 may pass through a filter 27 for removing impurities as is known in the art. Fill port 26 preferably includes a closing device (not shown) to facilitate pressurization of crucible 20.

Holding furnace 14 can be provided with wheel assemblies 28 to facilitate removal of holding furnace 14 from the casting machine frame (i.e., off of the rotary table) for maintenance.

Referring now to FIGS. 3, 4 and 6, a plurality of casting machines 10 are mounted on a rotary table 30. Rotary table 30 includes structural support beams 31 to reduce deflection. A table drive 32 provides motive power for indexing rotary table 30 to predetermined rotational positions. Programmable system controllers 33 are coupled to drive 32 and coordinate its movement. Controllers 33 are mounted in a raised control station 34 preferably located at the center of rotary table 30 and accessible by a ladder 35. Controllers 33 regulate operation of the molds and operation of the holding furnaces. Control station 34 may also include gas couplings, air couplings, electrical couplings, electric motors, and pumps to support operation of the rotary casting system. Rotary table 30 and table drive 32 are preferably positioned in a pit 38 below a work floor 36 such that rotary table 30 is about flush with work floor 36.

The illustrated rotary casting system includes six casting machines 10 on one rotary table 30, although the rotary casting system may include any suitable number of casting machines. The casting machines are supported at predetermined spacings and are preferably equally spaced at a predetermined interval (e.g., having their centers spaced at 60° intervals for six casting machines on a table).

Table drive 32 can comprise a hydrostatic drive or any other suitable power means. Rotary table 30 rotates in a direction illustrated by an arrow 37. Casting machines 10 revolve in the direction of arrow 37 and may be brought into any predetermined rotational position.

A molten metal supply apparatus 40 is located at a first fixed location adjacent to rotary table 30. Metal supply apparatus 40 delivers a selected volume of molten metal to holding furnace 14 through metal fill port 26 of a casting machine 10 that has been indexed to a fill position aligned with metal supply apparatus 40. In a preferred embodiment, metal supply apparatus 40 is retractable and may move in a trajectory to a fill position shown at 41. As shown in FIG. 6, molten metal supply apparatus obtains molten metal from a melt furnace 42 and a hold furnace 43, both of which are stationary. A de-gasser 44 may be interposed between furnaces 42 and 43.

A cast article removal apparatus 45 is located at a second fixed location adjacent to rotary table 30. Removal apparatus 45 is preferably comprised of a robotic arm for lifting a finished cast article out of a mold when a casting machine 10 is in its open mold configuration and has been indexed to an unload position aligned with removal apparatus 45. The robotic arm or other casting unloading device swings through a controlled trajectory to a position shown at 47 to deliver the finished casting to a transport (e.g., a conveyor belt 46 as shown in FIG. 6). Removal apparatus 45 may also present the finished casting (such as a cast aluminum wheel for a motor vehicle) to a human operator at an inspection position, such as is indicated generally at 48. Inspection position 48 allows inspection of a cast article 50 prior to delivery to conveyor 46. Inspection may be done by any suitable means, including visual, manual, scanning, or the like. Inspection position 48 is also conveniently located to permit inspection of an open mold from which cast article 50 was just removed so that if any debris remains in the mold, it can be removed prior to the next use of the mold.

In a preferred embodiment the fill position of a casting machine is coincident with the unload position so that the filling of molten metal and the removal of a cast article can occur simultaneously and at the same position of rotary table 30.

In operation, rotary table 30 positions each casting machine 10 in turn into alignment with molten metal supply apparatus 40 and cast article removal apparatus 45. After filling of the holding furnace and removal of the cast article, rotary table 30 is indexed to the position where the next casting machine 10 is in the fill/unload position. The first casting machine which has now moved on, moves into its closed mold configuration and pressurized gas is introduced to force molten metal into the closed mold. The mold is then cooled as rotary table is further indexed until the first casting machine returns to the fill/unload position and the cast article has hardened for removal from the mold. The molds preferably include integral cooling passages for receiving a cooling fluid under control of cooling controllers 51. The entire process is preferably engineered so that the time of one full revolution of table 30 is sufficient for solidification of the article.

More specifically, an operational sequence for making a cast article is as follows. Molten metal is transferred into a first holding furnace of a first casting machine with the rotary table positioned such that the first casting machine is in the fill position. As used herein, the transfer of molten metal can be obtained by pressure filling, pouring, or injection, for example. The rotary table is indexed such that a second casting machine is in the fill position. Molten metal is transferred into a second holding furnace of the second casting machine. The first casting machine is closed to the closed mold configuration. The first holding furnace is pressurized to fill the mold with molten metal. The rotary table is further indexed and molten metal is transferred into a least one more casting machine mounted on the rotary table. The second casting machine is closed to the closed mold configuration. The second holding furnace is pressurized to fill the second mold with molten metal. The molds cool in the first and second casting machines during filling of other casting machines with molten metal. The first casting machine is opened to the open mold configuration either before or after the first casting machine is indexed to the unload position. A cast article is removed from the first casting machine. Molten metal is transferred into the first holding furnace of the first casting machine. The second casting machine is indexed to the unload position. A cast article is removed from the second casting machine. Molten metal is transferred into the second holding furnace of the second casting machine. The first casting machine is closed to the closed mold configuration. The first holding furnace is pressurized to fill the mold with molten metal for the next cast article.

Depending upon the capacity of a holding furnace in a casting machine, it may not be necessary to refill it after each cast article produced. However, it is preferable to refill each time since a greater depth of molten metal helps ensure the least amount of gas or impurities in the metal moving up through the stalk tubes. Furthermore, it can be advantageous to reduce the overall size, weight, and capacity of the holding furnaces to reduce the cost of the rotary table.

Figure 5:
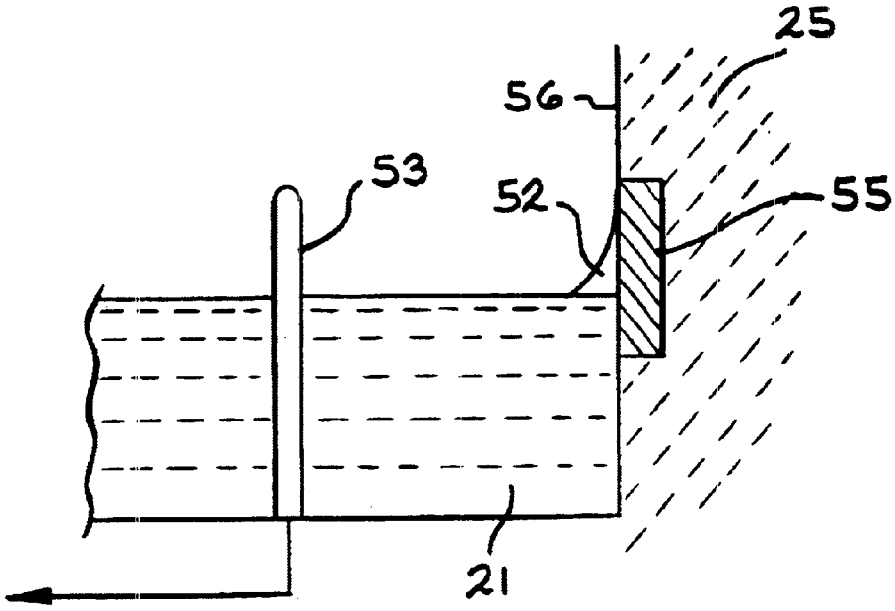
FIG. 5 is cross-sectional view of a holding furnace showing a side wall and a level sensor.

To maintain an optimum level of molten metal in a holding furnace, a level sensor 53 is provided within the furnace in contact with molten metal 21 as shown in FIG. 5. Level sensor 53 may be comprised of a known electrical probe, for example. A level signal is provided to molten metal supply apparatus 40 to control the amount of molten metal being charged into the respective holding furnace in order to maintain a full crucible.

Due to rotation of rotary table 30, molten metal 21 may slosh up the sides of crucible 20. Cooling of the metal could occur as it contacts the crucible side walls above the nominal level of the molten metal. A freeze-out 52 of metal might thus occur. To prevent freeze-out, a freeze-out prevention means 55 is provided in a side wall 56. Prevention means 55 can comprise a heat-conductive layer for keeping sloshing metal at the same temperature as the main body of molten metal, for example. Special shaping of the side walls or deflectors may also be employed. To reduce sloshing of molten metal both in the furnace and in a filled mold, other measures are also preferably taken. These measures include 1) designing table acceleration and deceleration profiles during indexing to minimize the amount of slosh, and 2) controlling the molten metal fill process for the mold(s) using a proportional fill method as described in copending application U.S. Ser. No. 10/045,659, entitled "Method for Filling a Casting Apparatus", which is incorporated herein by reference.

One or more optional workstations or change-out stations 57 may be placed around the periphery of rotary table 30. Change-out stations 57 are employed to permit changing of tools, perform casting machine maintenance (e.g., removing a holding furnace for cleaning), or perform additional manufacturing operations on the cast articles while in an open mold configuration.

FIG. 6 shows a second rotary casting system, in dotted lines, which is substantially identical to the first rotary casting system. The two rotary casting systems share melt furnace 42, hold furnace 43, and conveyor belt 46 to optimize manufacturing productivity.

The principle and mode of operation of this invention have been described in its preferred embodiments. However, it should be noted that this invention may be practiced otherwise than as specifically illustrated and described without departing from its scope.

What is claimed is:

1. Apparatus for making a cast article comprising:

a rotary table with a drive for indexing said rotary table to a plurality of rotational positions;

molten metal supply apparatus at a first fixed location adjacent to said rotary table;

a plurality of casting machines supported at predetermined spacings on said rotary table, each respective casting machine having a respective holding furnace feeding at least one respective stalk tube and having a molten metal inlet port for receiving molten metal from said molten metal supply apparatus when said respective casting machine is indexed to a fill position adjacent said first fixed location, each respective casting machine further adapted to receive at least one mold and having an open mold configuration and a closed mold configuration; and a cast article removal apparatus at a second fixed location adjacent said rotary table for removing said cast article from a respective casting machine when said respective casting machine is at an unload position adjacent said second fixed location and is in said open mold configuration;

wherein said fill position and said unload position are coincident such that a respective casting machine is refilled with molten while a completed cast article formed prior to reaching said unload position is removed from said respective casting machine.

2. The apparatus of claim 1 wherein each of said casting machines closes to its closed mold configuration and dispenses molten metal from its respective holding furnace through its respective stalk tube and then cools a resulting cast article while said respective casting machine indexes away from said fill position.

3. The apparatus of claim 1 wherein said holding furnace is refilled for each cast article made.

4. The apparatus of claim 1 further comprising: a change-out station at a third fixed location adjacent said rotary table, said change-out station including a maintenance apparatus for servicing said casting machines.

5.The apparatus of claim 1 wherein each of said casting machines further comprises a respective level sensor for sensing a molten metal level in each respective holding furnace, and wherein said casting machines communicate said sensed molten metal levels to said molten metal supply apparatus, said molten metal supply apparatus adjusting a molten metal pour to each respective holding furnace in response to said respective sensed molten metal level.

6. The apparatus of claim 1 wherein each of said holding furnaces further comprises side walls and freeze-out prevention means for avoiding buildup of solidified metal on said side walls.

7. A method of making cast articles in pressurized casting machines mounted on a rotary table at predetermined spacings, wherein said rotary table includes a drive for indexing to a plurality of rotational positions, wherein a molten metal supply apparatus is at a first fixed location adjacent to said rotary table, wherein each respective casting machine has a respective holding furnace feeding a respective stalk tube and having a molten metal inlet port for receiving molten metal from said molten metal supply apparatus when said respective casting machine is indexed to a fill position adjacent said first fixed location, wherein each respective casting machine is adapted to receive at least one mold and having an open mold configuration and a closed mold configuration, and wherein a cast article removal apparatus is at a second fixed location adjacent said rotary table for removing said cast article from a respective casting machine when said respective casting machine is at an unload position adjacent said second fixed location and is in said open mold configuration, said method comprising the steps of:

(a) transferring molten metal into a first holding furnace of a first casting machine with said rotary table such that said first casting machine is in said fill position;

(b) indexing said rotary table such that a second casting machine is in said fill position;

(c) transferring molten metal into a second holding furnace of said second casting machine;

(d) closing said first casting machine to said closed mold configuration;

(e) pressurizing said first holding furnace to fill said mold with molten metal;

(f) indexing said rotary table and transferring molten metal into at least one more casting machine mounted on said rotary table;

(g) closing said second casting machine to said closed mold configuration;

(h) pressurizing said second holding furnace to fill said second mold with molten metal;

(i) cooling said molds in said first and second casting machines during filling of other casting machines with molten metal;

(j) opening said first casting machine to said open mold configuration;

(k) indexing said first casting machine to said unload position;

(l) removing a cast article from said first casting machine;

(m) transferring molten metal into said first holding furnace of said first casting machine;

(n) indexing said second casting machine to said unload position;

(o) removing a cast article from said second casting machine;

(p) transferring molten metal into said second holding furnace of said second casting machine;

(q) closing said first casting machine to said closed mold configuration; and (r) pressurizing said first holding furnace to fill said mold with molten metal.

8. The method of claim 7 further comprising the steps of:

(s) sensing a molten metal level in said first holding furnace;

(t) communicating said sensed molten metal level to said molten metal supply apparatus; and (u) adjusting an amount of molten metal to be transferred into said first holding furnace.

9. The method of claim 7 wherein said fill positions in steps (a) and (b) and said unload positions in steps (k) and (n) are coincident.

* * * * *